US006766857B2

(12) United States Patent
Bixenman et al.

(10) Patent No.: US 6,766,857 B2
(45) Date of Patent: Jul. 27, 2004

(54) THRU-TUBING SAND CONTROL METHOD AND APPARATUS

(75) Inventors: Patrick W. Bixenman, Houston, TX (US); James A. Pramann, II, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/078,612

(22) Filed: Feb. 19, 2002

(65) Prior Publication Data

US 2002/0074119 A1 Jun. 20, 2002

Related U.S. Application Data

(63) Continuation of application No. 09/631,859, filed on Aug. 3, 2000, now Pat. No. 6,513,599.

(60) Provisional application No. 60/147,861, filed on Aug. 9, 1999.

(51) Int. Cl.[7] ..... E21B 43/04; E21B 43/08; E21B 47/12

(52) U.S. Cl. ..... 166/278; 166/250.01; 166/276; 166/51

(58) Field of Search ..... 166/250.01, 278, 166/276, 51, 66, 227

(56) References Cited

U.S. PATENT DOCUMENTS 5,964,296 A * 10/1999 Ross ..... 166/373
6,457,521 B1 * 10/2002 Langseth et al. ..... 166/264
6,505,682 B2 * 1/2003 Brockman ..... 166/250.15
6,554,064 B1 * 4/2003 Restarick et al. ..... 166/250.01

* cited by examiner

*Primary Examiner*—David Bagnell
*Assistant Examiner*—Shane Bomar
(74) *Attorney, Agent, or Firm*—Trop, Pruner & Hu, P.C.; Jeffrey E. Griffin; Brigitte Jeffery Echols

(57) ABSTRACT

In one aspect, the invention may be a well completion including a production tubing, an upper packer connected to a lower end of the production tubing, an intelligent device disposed below the upper packer, a continuous control cable running from the intelligent device to a connection point, and a sand screen disposed below the packer. The completion may be installed in a well in a single trip, instead of multiple. Sand-control operations may be performed by a service tool that is deployed through the production tubing. The completion may include the ability to washdown the well as the completion is being run into place. Related methods are also provided.

25 Claims, 11 Drawing Sheets

THRU-TUBING SAND CONTROL METHOD AND APPARATUS

RELATED APPLICATIONS

This application is a continuation of U.S. patent application Ser. No. 09/631,859, filed Aug. 3, 2000 now U.S. Pat. No. 6,513,599 which claims the benefit of U.S. Provisional Application No. 60/147,861, filed Aug. 9, 1999.

BACKGROUND OF THE INVENTION

1. Field of the Invention

The present invention relates to subsurface well equipment and, more particularly, to a thru-tubing sand control method and apparatus.

2. Description of the Related Art

It is well known to those engaged in the exploration of oil and gas that certain subterranean hydrocarbon-producing formations have sand commingled with the hydrocarbons. For various reasons, which are well-known in the art, it is not desirable to produce the commingled sand to the earth's surface along with the hydrocarbons. As such, the industry developed sand-control completions that, in broad terms, include an upper and an optional lower, or sump, packer with various mechanisms disposed therebetween, including a closing sleeve and a sand screen. The upper packer, such as a seal bore retrievable packer, is initially connected to a service string, and the entire sand-control completion is lowered into the well on the service string until the sand screen is positioned adjacent the hydrocarbon-producing formation. If the well is cased, then the sand screen will be positioned adjacent perforations in the casing. A service tool in the service string is used to perform various functions and operations with regard to the sand-control completion, including washing down the well bore as the string is run into the well bore, setting the packers, displacing fluids in the annulus above the upper packer, squeezing fluids into the production annulus and into the formation (e.g., through the casing perforations), packing gravel into the annulus between the sand screen and the formation, circulating fluids into the production annulus, and reverse-circulating fluids out of the service tool and service string. After all necessary operations have been carried out, and the sand-control completion is ready to produce the hydrocarbons to the earth's surface, the service string and tool are disconnected from the upper packer and removed from the well. A production tubing is then lowered into the well and connected to the upper packer, at which time production operations may commence. All of these functions and operations are known to those skilled in the art of sand-control and gravel pack completions.

It is also well known to those engaged in the exploration of oil and gas that there has been a move towards "smart" or "intelligent" well completions in which various mechanisms (e.g., temperature sensors, pressure sensors, flow-control devices, etc.) are attached to the completion and to one or more control cables or conduits (e.g., electrical, hydraulic, fiber optic, etc.) running to the earth's surface. The sensors transmit downhole well data to the earth's surface via the cables, or the flow-control devices may be remotely controlled from the earth's surface to control downhole fluid flow. A problem has developed, however, in applying this "smart" or "intelligent" concept to sand-control completions. Specifically, since sand-control completions have traditionally been run into the well on a service string, which is then removed and replaced with the production tubing, as explained above, it is not possible to have a continuous run of control cable to the earth's surface (or to some connection point above the upper packer) from a sensor, flow-control device, etc. located below the upper packer. As such, if the traditional sand-control completion process is employed, there would be a section of control cable running from the sensor in the sand-control completion to the upper packer, and then another section of control cable running from the upper packer to the earth's surface (or to some connection point above the upper packer). This latter section of control cable would be part of the production tubing that is stabbed into the upper packer after removal of the service string. This would require that a "wet" connection be made at the upper packer between the two sections of control cable. For reliability reasons, it is preferred to avoid the use of "wet" connections, and, instead, run a continuous section of control cable from the various monitoring and fluid-control devices to the earth's surface (or other connection point above the upper packer). To achieve this goal, the completion hardware for sand control and all other completion hardware and tubing from the upper packer to the top of the well bore must be inserted into the well in one run. The present invention has been contemplated to meet this need while at the same time providing the completion with all the necessary pumping operations and hardware placement for sand control.

SUMMARY OF THE INVENTION

In a broad aspect, the invention may be a well completion comprising: a production tubing; an upper packer connected to a lower end of the production tubing; an intelligent device disposed below the upper packer; a continuous control cable running from the intelligent device to a connection point; and a sand screen disposed below the packer. Another feature of the present invention is that the completion may further include a first closing sleeve disposed between the upper packer and the production tubing and remotely movable between an open position and a closed position. Another feature of the present invention is that the completion may further include at least one of a first polished bore receptacle disposed above the first closing sleeve and a second polished bore receptacle disposed between the first closing sleeve and the upper packer. Another feature of the present invention is that the completion may further include a second closing sleeve disposed between the upper packer and the sand screen and remotely movable between an open position and a closed position. Another feature of the present invention is that the control cable is sealably disposed through a port in the upper packer. Another feature of the present invention is that the completion may further include a washpipe movable from a first position to a second position, the washpipe restricting fluid flow through the sand screen when in the first position and permitting fluid flow through the sand screen when in the second position. Another feature of the present invention is that the completion may further include an upper washpipe nipple having an upper latching profile and a lower washpipe nipple having a lower latching profile, and wherein the washpipe includes a latching mechanism releasably engageable with the nipple profiles, the mechanism being engaged with the lower profile when in the first position and with the upper profile when in the second position. Another feature of the present invention is that the washpipe includes a gripping profile releasably engageable with a gripping mechanism on a service tool that is deployed through the production tubing. Another feature of the present invention is that the intelligent device is disposed in one of a first and a second position, the first position being between the packer and the sand screen, and the second position being below the sand screen. Another feature of the present invention is that the intelligent device may be disposed within the sand screen. Another feature of the present invention is that the intelligent device is one of a temperature sensor, a pressure sensor, a flow-control device, a flow rate measurement device, an oil/water/gas ratio measurement devices, a scale detector, and a sand detection device. Another feature of the present invention is that the control cable includes at least one of an electrical cable, a fiber optic cable and a hydraulic control line. Another feature of the present invention is that the upper packer is a multiport packer and adapted to sealably pass at least one cable in the control cable therethrough. Another feature of the present invention is that the completion may further include a safety shear sub shearably disposed between the upper packer and the sand screen. Another feature of the present invention is that the completion may further include a lower packer disposed below the sand screen. Another feature of the present invention is that the completion may further include a valve-shifting collar disposed below the upper packer and above the sand screen, and adapted to shift a ball valve in a through-tubing service tool between open and closed positions. Another feature of the present invention is that the completion may further include a service tool disposed for longitudinal movement through the production tubing and adapted to perform sand-control operations in the completion. Another feature of the present invention is that the service tool includes a shifting profile releasably engageable with at least one of a shifting profile on a first closing sleeve disposed above the upper packer, a shifting profile on a second closing sleeve disposed below the upper packer, and a valve-shifting collar disposed below the upper packer. Another feature of the present invention is that the service tool includes a crossover housing having a packer-setting port adapted to direct pressurized fluid to hydraulically set the upper packer.

In another aspect, the invention may be a method of installing a sand-control completion, comprising: assembling the sand-control completion, the completion including a production tubing, an upper packer connected to a lower end of the production tubing, an intelligent device disposed below the packer, a continuous control cable running from the intelligent device to a connection point above the upper packer, and a sand screen disposed below the upper packer; and running the completion into a well and setting it in the well with the sand screen disposed adjacent a hydrocarbon-producing formation in a single trip. Another feature of the present invention is that the method further includes a washpipe disposed within the completion to restrict fluid flow through the sand screen, the method further including washing the well as the completion is being run into the well. Another feature of the present invention is that the method may further include running a service tool through the production tubing to perform at least one sand-control operation in the completion. Another feature of the present invention is that the method may further include running a service tool through the production tubing to shift a washpipe in the completion from a first position to a second position, the washpipe restricting fluid flow through the sand screen when in the first position and allowing fluid flow through the sand screen when in the second position. Another feature of the present invention is that the method may farther include running a service tool through the production tubing to direct pressurized fluid to the upper packer to remotely control the upper packer. Another feature of the present invention is that the method may further include running a service tool through the production tubing to direct fluid to a well annulus below the upper packer, and squeezing fluid into a hydrocarbon-producing formation disposed adjacent the sand screen. Another feature of the present invention is that the method may further include stroking the service tool to a circulating position, and circulating fluid from the production tubing into the annulus below the packer, through the sand screen, into a longitudinal bore of the service tool, through a crossover housing in the service tool, and upwardly to the earth's surface. Another feature of the present invention is that the fluid is directed from a crossover housing in the service tool to the earth's surface through the annulus above the upper packer. Another feature of the present invention is that the fluid is directed from a crossover housing in the service tool to the earth's surface through the production tubing. Another feature of the present invention is that the method may further include stroking the service tool to shift a ball valve therein from an open position to a closed position, raising the service tool, and circulating fluid from the earth's surface through a crossover housing in the service tool, into the production tubing, and upwardly to the earth's surface. Another feature of the present invention is that the method may further include engaging the service tool with a washpipe disposed in the completion and removing the service tool and washpipe from the completion.

In another aspect, the invention may be a washpipe assembly for use in a sand-control completion having a sand screen disposed below an upper packer, the washpipe assembly comprising: a washpipe having an upper end and a lower end, the washpipe being remotely shiftable from a first position to a second position, the washpipe restricting fluid flow through the sand screen when in the first position and permitting fluid flow through the sand screen when in the second position, and the washpipe being in the first position and releasably connected to the sand-control completion when the sand-control completion is being run in to a well. Another feature of the present invention is that the assembly may further include a lower annular seal disposed adjacent the lower end of the washpipe; and an upper annular seal disposed adjacent the upper end of the washpipe, the upper end of the washpipe being sealably disposed above the sand screen and the lower end of the washpipe being sealably disposed below the sand screen when the washpipe is in the first position. Another feature of the present invention is that the completion may further include an upper washpipe nipple having an upper latching profile and a lower washpipe nipple having a lower latching profile, and wherein the washpipe includes a latching mechanism releasably engageable with the nipple profiles, the mechanism being engaged with the lower profile when in the first position and with the upper profile when in the second position. Another feature of the present invention is that the latching mechanism is a collet. Another feature of the present invention is that the washpipe further includes a gripping profile releasably engageable with a gripping mechanism on a service tool that is deployed through a production tubing.

In another aspect, the invention may be a well completion comprising: a production tubing; an upper packer connected to a lower end of the production tubing; a sand screen disposed below the packer; and a through-tubing service string and tool adapted to be deployed through the production tubing for performing sand-control operations within the completion. Another feature of the present invention is that the completion may further include at least one of (1) a flowpath above the upper packer through an inner annulus formed between the service string and the production tubing and (2) a flowpath above the upper packer through a well annulus formed between the production tubing and a well bore. Another feature of the present invention is that the service tool includes a shifting profile releasably engageable with at least one of a shifting profile on a first closing sleeve disposed above the upper packer, a shifting profile on a second closing sleeve disposed below the upper packer, and a valve-shifting collar disposed below the upper packer. Another feature of the present invention is that the service tool includes a port adapted to direct pressurized fluid to hydraulically set the upper packer. Another feature of the present invention is that the completion may further include an intelligent device disposed below the upper packer; and a continuous control cable running from the intelligent device through a port in the upper packer to a connection point. Another feature of the present invention is that the completion may further include a washpipe movable from a first position to a second position, the washpipe restricting fluid flow through the sand screen when in the first position and permitting fluid flow through the sand screen when in the second position. Another feature of the present invention is that the completion may further include an upper washpipe nipple having an upper latching profile and a lower washpipe nipple having a lower latching profile, and wherein the washpipe includes a latching mechanism releasably engageable with the nipple profiles, the mechanism being engaged with the lower profile when in the first position and with the upper profile when in the second position. Another feature of the present invention is that the washpipe includes a gripping profile releasably engageable with a gripping mechanism on a service tool that is deployed through the production tubing.

BRIEF DESCRIPTION OF THE DRAWINGS

Other features and advantages of the present invention will become more fully apparent from the following detailed description, appended claims, and the accompanying drawings in which:

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

For purposes of this description, the terms "upper," "lower," "uphole," and "downhole" are relative terms to indicate position and direction of movement in easily recognized terms. Usually these terms are relative to a line drawn perpendicularly downward from the center of the borehole at the earth's surface, and would be appropriate for use in straight, relatively vertical wellbores. However, when the wellbore is highly deviated, such as from about horizontal to about 60 degrees from vertical, or if there are multiple laterals, these usually comfortable terms to persons skilled in the art may not make sense. Use of these terms are for ease of understanding as an indication to what relative position or movement would be if the well were vertical, and should not be construed to limit the scope of the invention.

Figure 1A:
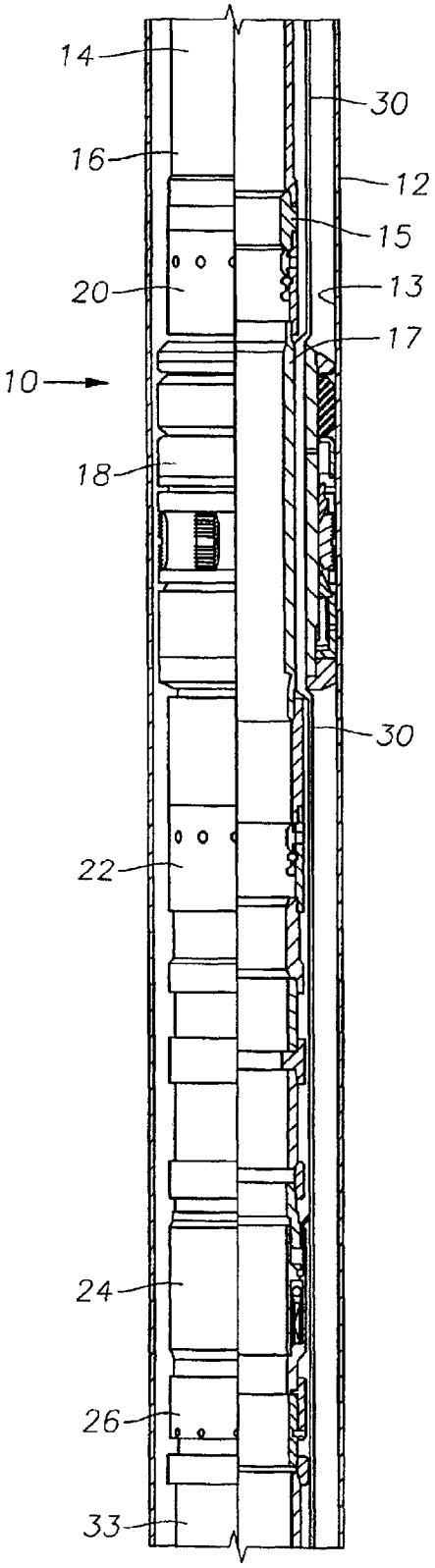
FIGS. 1A–1B illustrate a longitudinal view in partial cross-section of one embodiment of the present invention, with the completion in an installation position.
Figure 1B:
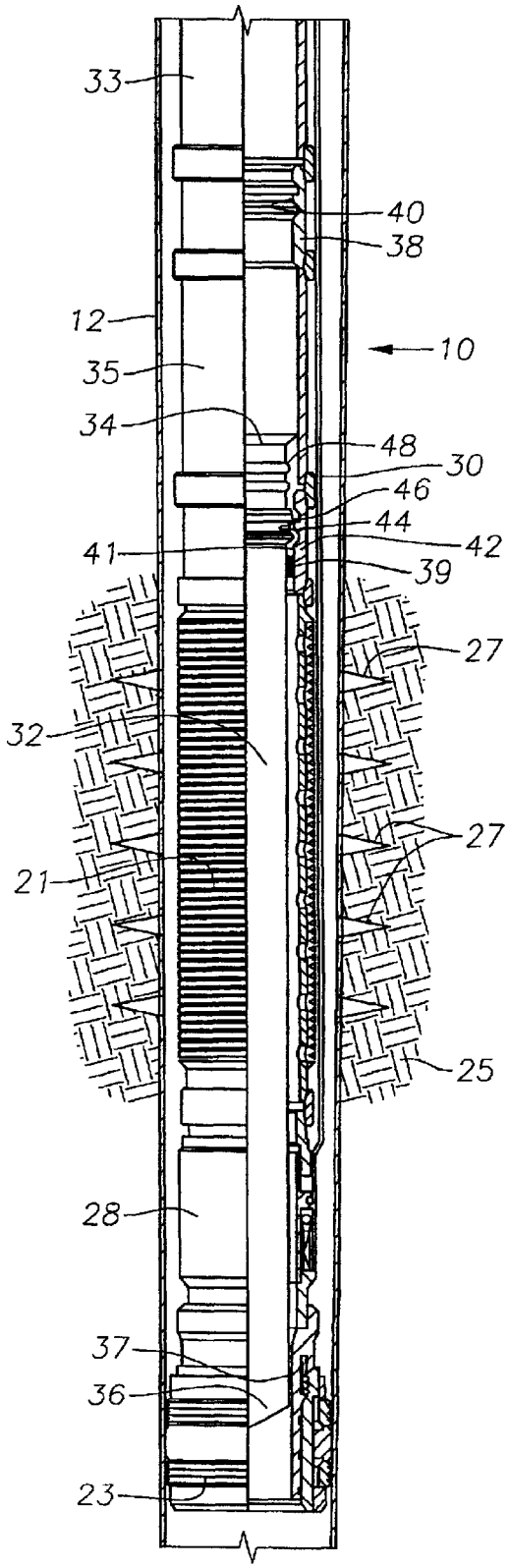

Referring to the drawings in detail, wherein like numerals denote identical elements throughout the several views, one embodiment of the sand-control completion 10 of the present invention is shown in FIGS. 1A–1B disposed in a casing 12 in an installation configuration. As shown in FIGS. 1A–1B, the completion 10 may include a production tubing 14 disposed within a well bore 13 formed by the casing 12, and having a lower end 16 connected to an upper packer 18. The production tubing 14 may be any type of tubing known to those of skill in the art, including coiled tubing. A first closing sleeve 20 may be connected between the upper packer 18 and the production tubing 14, and is generally closed when the completion 10 is being run into the well bore 13. The completion 10 may include a first polished bore receptacle 15 above the first closing sleeve 20 and a second polished bore receptacle 17 below the first closing sleeve 20 and above, or part of, the upper packer 18, the function of which will be explained below. The completion 10 further includes a sand screen 21 (see FIG. 1B) below the upper packer 18, and may further include a lower, or sump, packer 23 below the sand screen 21; the sump packer 23 is not necessary unless isolation below the sand screen 21 is desired. As shown in FIG. 1B, the sand screen 21 is positioned adjacent a hydrocarbon-producing formation 25. If the well bore 13 is cased, as shown, then communication is established between the formation 25 and the well bore 13 through a number of perforations 27 in the casing 12.

The completion 10 may further include a second closing sleeve 22 between the upper packer 18 and the sand screen 21, a first intelligent device 24 (e.g., pressure sensor, temperature sensor, flow control device, etc.) between the upper packer 18 and the sand screen 21, a safety shear sub 26, and a second intelligent device 28 below the sand screen 21, such as between the sand screen 21 and the lower packer 23 (see FIG. 1B), as well as other intelligent devices and other components. The second closing sleeve 22 is closed when the completion 10 is being run into the well bore 13. For purposes of this invention the term "intelligent device" includes any device used in "intelligent" or "smart" well completions, including but not limited to devices such as temperature sensors, pressure sensors, flow-control devices, flow rate measurement devices, oil/water/gas ratio measurement devices, scale detectors, sand detection device, and the like. The completion 10 may include any number and any combination of these intelligent devices below the upper packer 18. The safety shear sub 26 is disposed above the sand screen 21, and allows the portion of the completion 10 above the shear sub 26 to be removed in the event that the portion of the completion 10 below the shear sub 26 becomes stuck or if the string must be pulled for other reasons. A continuous section of control conduit 30 is connected between a "connection point" and the intelligent devices 24 and 28. The "connection point" may be located at the earth's surface or at some intermediate point between the upper packer 18 and the earth's surface. For example, in a multilateral well, the "connection point" may be at an inductive coupler or downhole controller located between the earth's surface and the upper packer 18. As used here, the term "continuous" does not mean that there are no connections between discrete sections of control conduit 30 between the connection point and the intelligent devices 24 and 28, but, instead, that all such connections are made in a sufficiently sealed manner at the connection point, not remotely after the sections of control conduit are already inside the well (i.e., none of the connections is a "wet" connection). In a specific embodiment, the control conduit 30 may include a plurality of cables, such as one or more electrical, fiber optic or hydraulic cables for transmitting data, signals, pressurized fluid, power, etc. from the intelligent devices 24 and 28. It is noted that the upper packer 18 should be of the "multiport" type (i.e., one that allows for passage of a plurality of control lines therethrough), also known as a "control line bypass" packer, and be capable of sealably passing the various cables 30 therethrough while at the same time maintaining pressure integrity. As such, the various cables 30 pass through the upper packer 18 and connect to the various intelligent devices (e.g., 24 and 28). In a specific embodiment, the intelligent device 28 may be an in-line flow control device 28 disposed between the sand screen 21 and the sump packer 23 for control of production from below the sump packer 23. It is further noted that a hydraulic cable within the control conduit 30 may be connected to the upper packer 18 for remotely controlling the setting and releasing thereof. In addition to using hydraulics to set the multiport upper packer 18, there are a variety of other ways, as known to those of skill in the art, by which the packer 18 may be set, including by tubing, control line, or any other method known to those of skill in the art.

With reference to FIG. 1B, the sand-control completion 10 may further be provided with a washpipe 32 having an upper end 34 and a lower end 36. During the installation mode, as shown in FIGS. 1A and 1B, the washpipe 32 is sealably disposed within and through the sand screen 21, with its upper end 34 sealably disposed above the sand screen 21 and its lower end 36 sealably disposed below the sand screen 21. The lower end 36 of the washpipe 32 may include a lower annular seal 37 that may be sealably received within the sump packer 23 or another polished bore receptacle to prevent fluid flow through the sand screen 21. The upper end 34 of the washpipe 32 may include an upper annular seal 39 that may be sealably received within a seal bore 41 of a lower washpipe nipple 42. The completion 10 may further include an upper washpipe nipple 38 having an upper latching profile 40 disposed about its interior, and the lower washpipe nipple 42 may have a lower latching profile 44 disposed about its interior. Both nipples 38 and 42 are disposed between the upper packer 18 and the sand screen 21. The upper end 34 of the washpipe 32 may further include a latching mechanism or profile 46 disposed about its exterior that is releasably engageable with the upper and lower latching profiles 40 and 44 on the upper and lower washpipe nipples 38 and 42, respectively. In a specific embodiment, the latching mechanism 46 may be a collet connected to the upper end 34 of the washpipe 32. When the completion is in its installation configuration, as shown in FIGS. 1A and 1B, the latching mechanism 46 on the upper end 34 of the washpipe 32 is releasably engaged with the lower latching profile 44 of the lower washpipe nipple 42. The upper end 34 of the washpipe 32 may further include a gripping profile 48 disposed about its interior, the purpose of which will be explained below. The washpipe 32 functions to isolate the sand screen 21 and allow washdown circulation capability as the completion 10 is being run into the well bore 13. By isolating the sand screen 21 with the washdown pipe 32, it is possible to pump washdown fluid to the bottom of the completion 10 as it is being run into the well bore 13.

Figure 11:
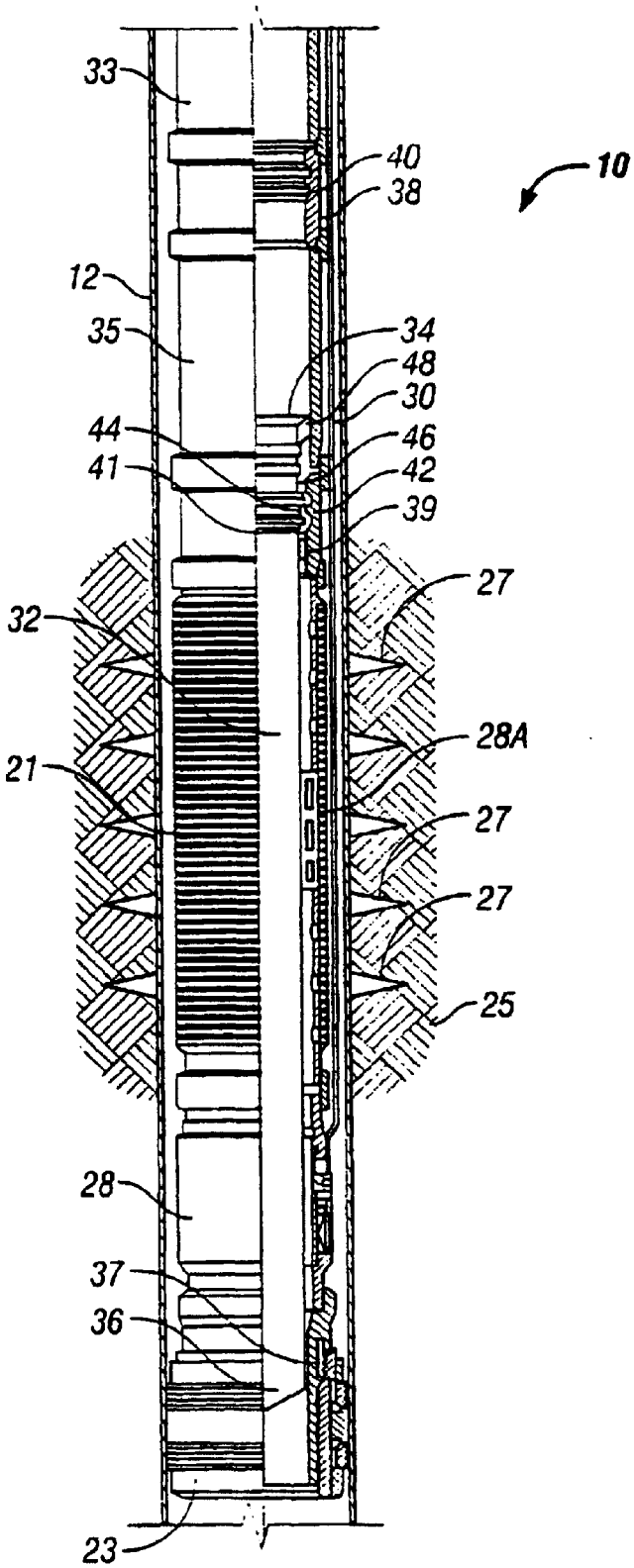
FIG. 11 is a longitudinal view in partial cross-section of another embodiment of the invention.

FIG. 11 shows the identical section of the sand-control completion 10 as in FIG. 1B, with the only difference being the presence of intelligent device 28A disposed within the sand screen 21.

Thus far, two of the unique features of the present invention have been identified, one of them being that the completion 10 is installed in one trip, instead of two, and provides a continuous control conduit 30 from the intelligent devices 24 and 28 to the connection point, thereby avoiding the use of wet connections. Another of the unique aspects of the present invention identified above is that the washpipe 32 allows the completion 10 to be installed in a single trip without sacrificing the ability to perform washdown circulation functions as the completion 10 is being run into place. Another unique feature of the present invention will now be described, namely, the ability to run a service tool inside, or through, the production tubing 14 to perform the various necessary sand-control pumping and circulating operations.

Figure 2A:
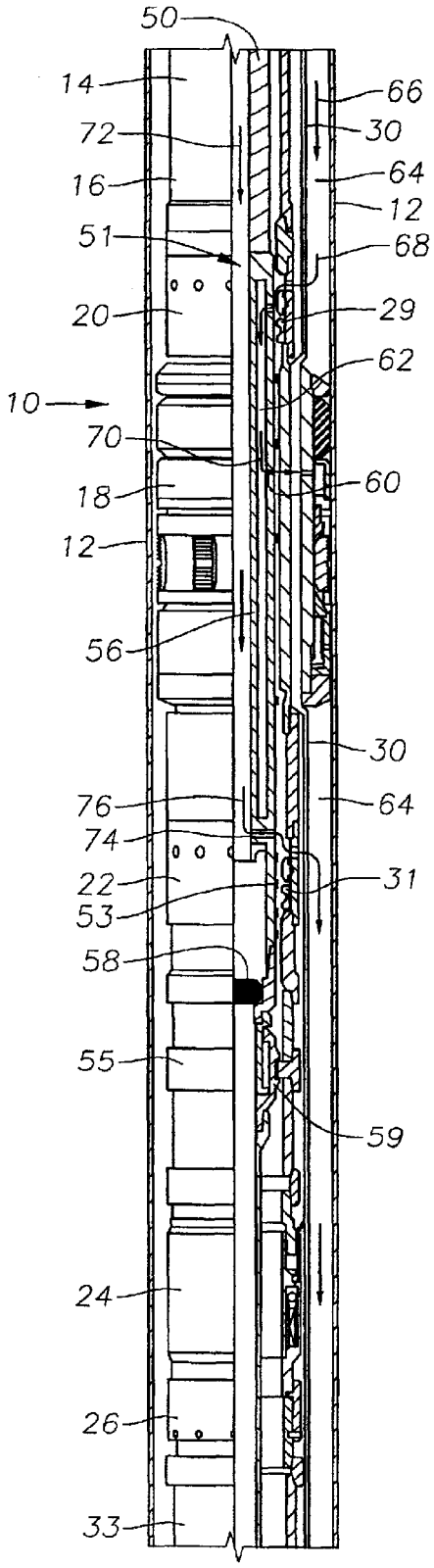
FIGS. 2A–2B illustrate a longitudinal view in partial cross-section of the embodiment shown in FIGS. 1A–1B, only now in a packer-setting and squeeze position.
Figure 2B:
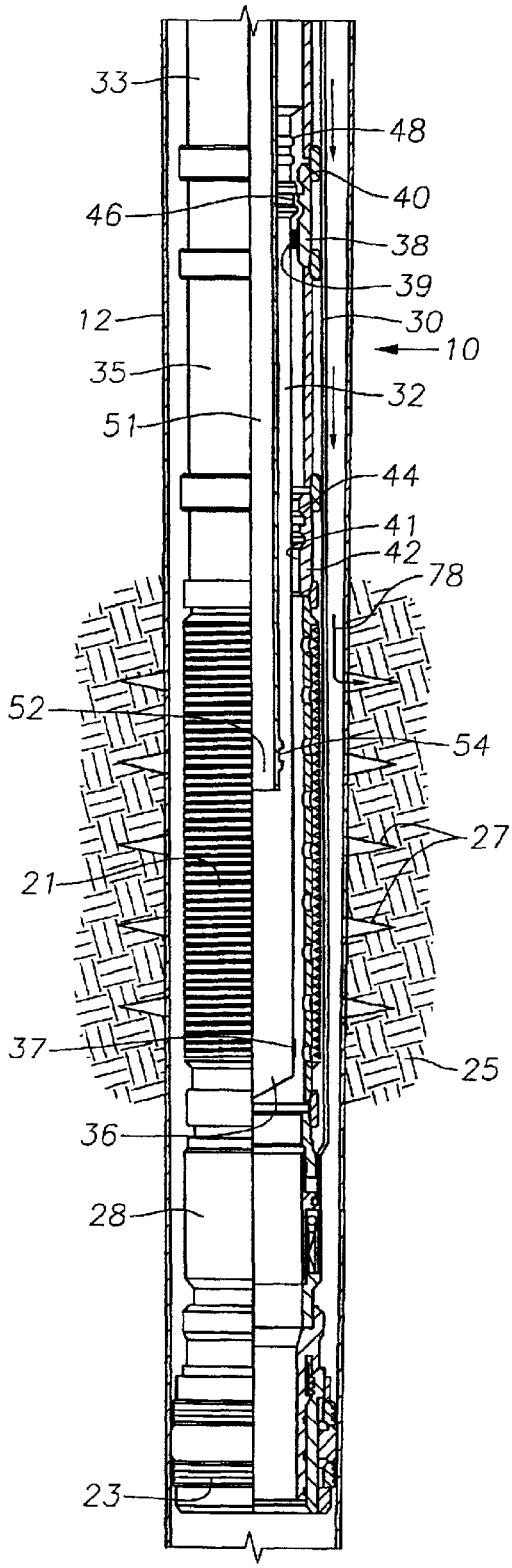

Referring now to FIGS. 2A and 2B, a thru-tubing service string 50 is shown disposed within the production tubing 14 and connected to a service tool 51. The service string 50 may be any type of string known to those of skill in the art, including but not limited to jointed tubing, coiled tubing, etc. The service tool 51 includes a lower end 52 disposed within the sand screen 21. The lower end 52 of the service tool 51 is provided with a gripping mechanism 54 that is releasably engageable with the gripping profile 48 at the upper end 34 of the washpipe 32. By releasably engaging the gripping mechanism 54 on the service tool 51 with the gripping profile 48 on the washpipe 32, the service tool 51 may be used to remotely grab and move the washpipe 32 from its first, or sand-screen isolating, position, shown in FIG. 1B, to its second position, shown in FIG. 2B. In this second position, circulation is permitted from a well annulus 64, formed between the production tubing 14 and the well casing 12, through the sand screen 21 and into the production tubing 14. The service tool 51 may be similar in structure and operation to service tools of the type discussed above that have been traditionally used in deploying sand-control completions, and may include a standard crossover housing 56 and a ball valve 58, except that the service tool 51 of the present invention is run through the tubing 14 and is not provided with the structure used in previously existing service tools to attach to and set the upper packer 18. While the service tool 51 is shown with a ball valve 58, that should not be taken as a limitation and the present invention is intended to cover service tools 51 that lack a ball valve 58. For example, the service tool 51 may be of the type that is manipulated by movement of the service tool 51 relative to the upper packer 18. In addition, in those situations where it is desired to provide the completion 10 with washdown capability, another difference is that the service tool 51 is provided with the above-discussed gripping mechanism 54 at its lower end 52 for remotely shifting the washpipe 32, whereas previously the washpipe 32 was part of the service tool.

With reference to FIG. 2A, the completion 10 may include a valve-shifting collar 55 disposed below the second closing sleeve 22 and above the sand screen 21. Movement of the ball valve 58 relative to the collar 55 will open and close the ball valve 58. The collar 55 should be located so as to be above the upper end 34 of the washpipe 32 when the washpipe 32 is in its first and second positions. The service tool 51 may be provided with a shifting profile 59 for mating with: a shifting profile 29 on the first closing sleeve 20; a shifting profile 31 on the second closing sleeve 22; and the collar 55. As the service tool 51 is run through the tubing 14 and into the portion of the completion 10 below the upper packer 18, the shifting profile 59 is used to shift the first and second closing sleeves 20 and 22 to their open positions. It is noted that the first and second closing sleeves 20 and 22 may also be shifted between their open and closed positions by any known intervention tool. The service tool 51 is then set in a first position, as shown in FIGS. 2A and 2B, by engaging the shifting profile 59 with the collar 55. It is further noted that, if a washpipe 32 is included, the completion 10 should be provided with adequate blank pipe 33 and 35 between the gripping mechanism 54 at the lower end 52 of the service tool 51 and the ball valve 58 to allow enough stroke for the service tool 51 to performer the various pumping operations.

If the upper packer 18 is to be hydraulically set, then the service tool 51 should be provided with the necessary structure to direct pressurized fluid to set the upper packer 18. In this regard, in a specific embodiment, the crossover housing 56, shown in FIG. 2A, may be provided with a packer-setting port 60 in communication with a longitudinal passageway 62 in the crossover housing 56. When the completion 10 and the service tool 51 are in the configuration shown in FIGS. 2A and 2B, the first closing sleeve 20 is open thereby establishing fluid communication with the well annulus 64. This permits fluid flow from the annulus 64 through the first closing sleeve 20 and into the longitudinal passageway 62 in the crossover housing 56, as indicated by arrows 66 and 68. Pressurized fluid is then directed from the longitudinal passageway 62 through the packer-setting port 60, as indicated by arrow 70, to hydraulically set the upper packer 18. As noted above, this is just one example of how to set the upper packer 18 and should not be taken as a limitation on the scope of the invention.

FIGS. 2A and 2B also illustrate the completion 10 and the service tool 51 in a squeeze configuration. It is noted that, in this configuration, the gripping mechanism 54 at the lower end 52 of the service tool 51 has been used to move the washpipe 32 from its first, or sand-screen isolating, position, as shown in FIG. 1B, to its second position, as shown in FIG. 2B. It is further noted that for all remaining operations the gripping mechanism 54 at the lower end 52 of the service tool 51 will stay below the gripping profile 48 at the upper end 34 of the washpipe 32 so long as the washpipe 32 remains in the completion 10. In the position shown in FIGS. 2A and 2B, fluid represented by arrow 72 at the top of FIG. 2A moves downwardly within the production tubing 14 and is directed through a radial port 74 in the crossover housing 56 and through the open second closing sleeve 22 into the annulus 64 below the upper packer 18, as indicated by arrow 76. It is noted that the service tool 51 may include one or more annular seals 53 to prevent downward fluid flow into the space between the service tool 50 and the completion 10. The fluid continues down the annulus 64 and is squeezed into the formation 25 through the perforations 27, as indicated, for example, by arrow 78. The ball valve 58 is closed during this operation.

Figure 3A:
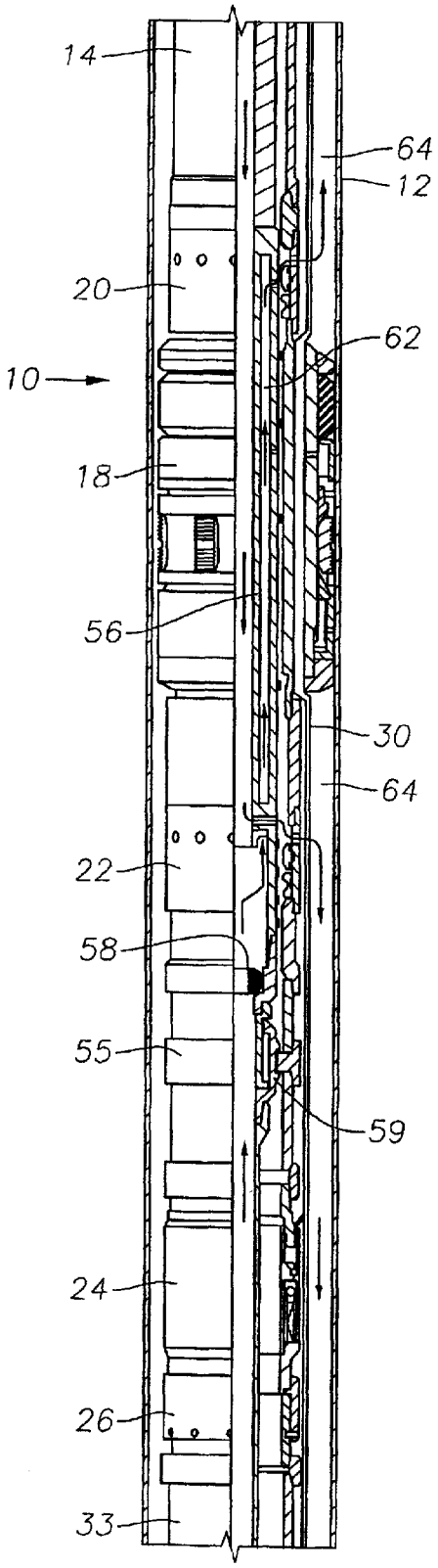
FIGS. 3A–3B illustrate a longitudinal view in partial cross-section of the embodiment shown in FIGS. 1A–1B, only now in a circulating position.
Figure 3B:
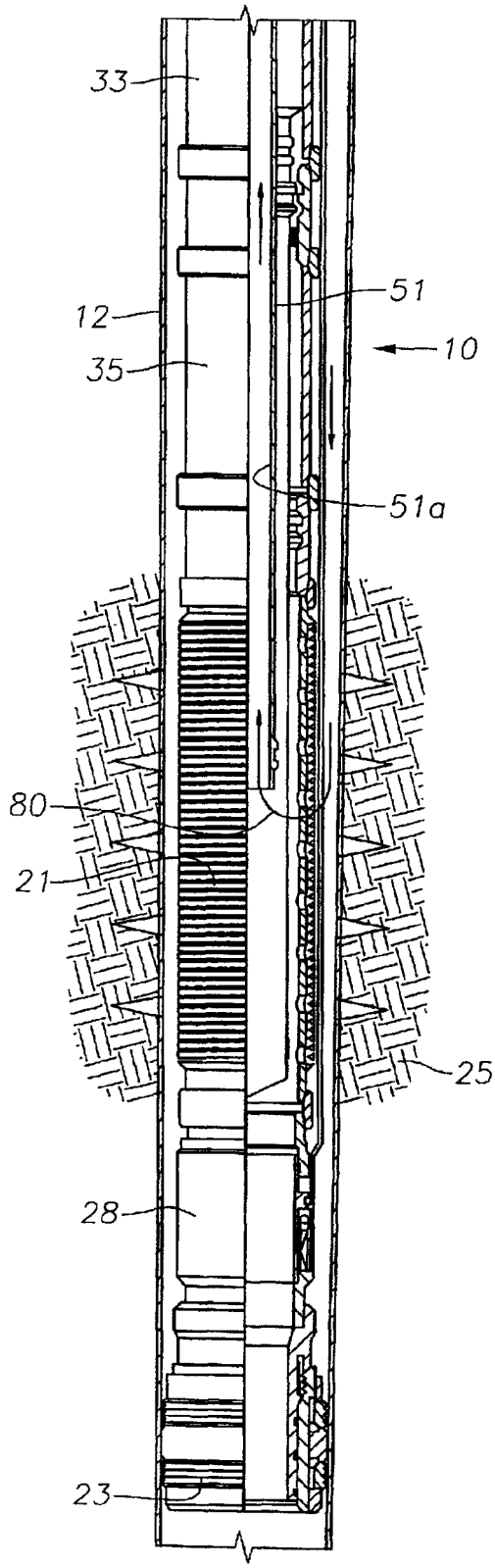

FIGS. 3A and 3B illustrate the completion 10 in a circulating configuration, which has been achieved by stroking the service tool 51 to open the ball valve 58, in the manner discussed above. In this configuration, fluid flow is directed down the production tubing 14 and into the annulus 64 below the upper packer 18 in the same manner as discussed above with regard to FIGS. 2A and 2B. Instead of squeezing the fluid into the formation 25, as with regard to FIG. 2B, the fluid here is circulated through the sand screen 21 and into a longitudinal bore 51*a* of the service tool 51, as indicated by arrow 80. Fluid flow then continues upwardly through the open ball valve 58, into the longitudinal passageway 62 in the crossover housing 56, out through the open first closing sleeve 20 and into the annulus 64 above the upper packer 18 for circulation to the earth's surface. As is well known to those of skill in this art, gravel may be delivered and packed into the annulus 64 between the casing 12 and the sand screen 21 during this operation. In addition to using the present invention for gravel packing purposes, it may also be used for many other purposes, such as for cleaning, stimulating and fracturing, to name a few.

Figure 4A:
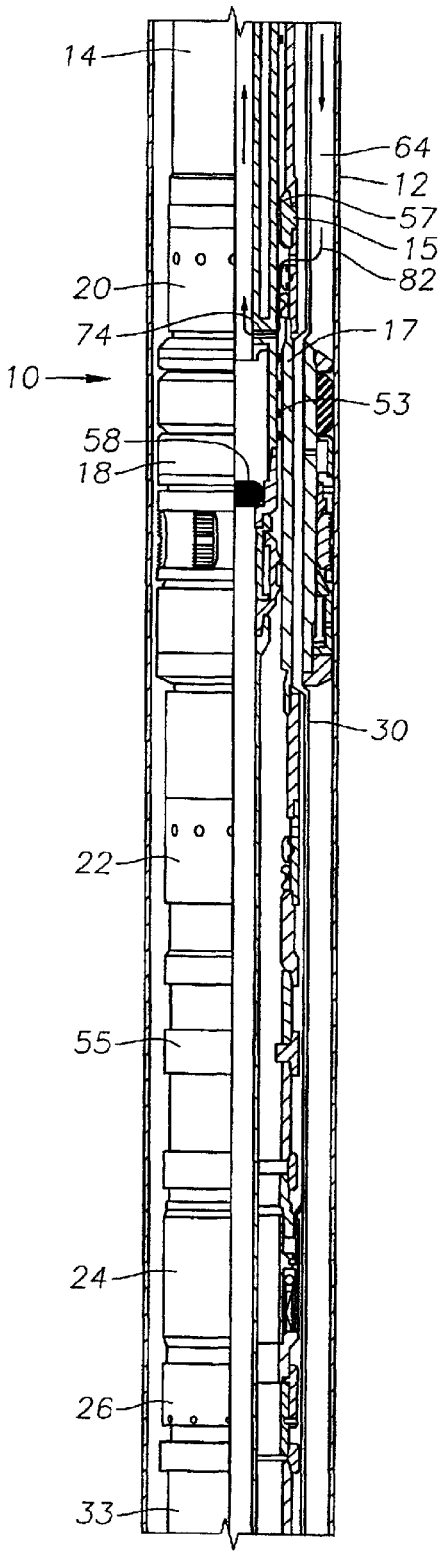
FIGS. 4A–4B illustrate a longitudinal view in partial cross-section of the embodiment shown in FIGS. 1A–1B, only now in a reverse circulating position.
Figure 4B:
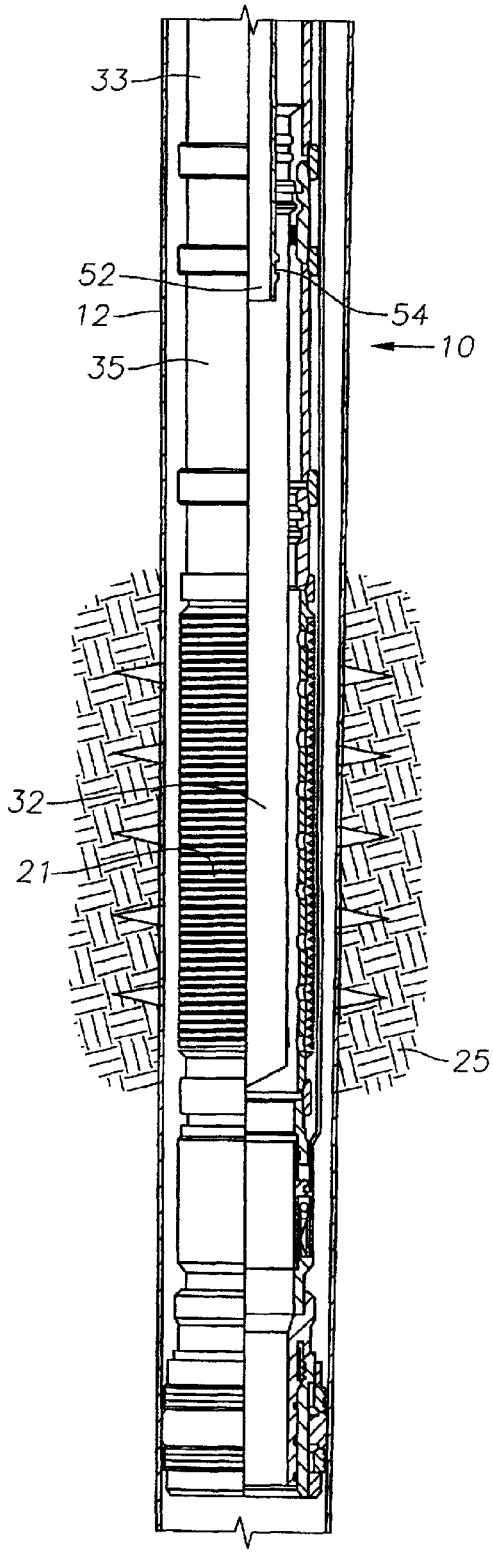

FIGS. 4A and 4B illustrate the completion 10 in a reverse circulating configuration, which has been achieved by stroking the service tool 51 to close the ball valve 56, in the manner discussed above, and then by raising the service tool 51 upwardly to establish fluid communication from the well annulus 64 through the open first closing sleeve 20, through the radial port 74 in the crossover housing 56, and into the service string 50, as indicated by arrow 82. It is noted that the second closing sleeve 22 is closed by the service tool 51 when the service tool 51 is moved upwardly to its position as shown in FIGS. 4A and 4B. It is further noted that fluid flow downwardly into the space between the service tool 51 and the second polished bore receptacle 17 is prevented by the seals 53. Likewise, another annular seal 57 disposed about the service tool 51 is disposed within the first polished bore receptacle 15 when the service tool 51 is in this position to prevent upward fluid flow into the annular space between the service string 50 and the production tubing 14. Finally, it is noted with reference to FIG. 4B that the gripping profile 54 at the lower end 52 of the service tool 51 is below the gripping profile 48 at the upper end 34 of the washpipe 32 when the service tool 51 and the completion 10 are in the reverse circulating configuration.

Figure 5A:
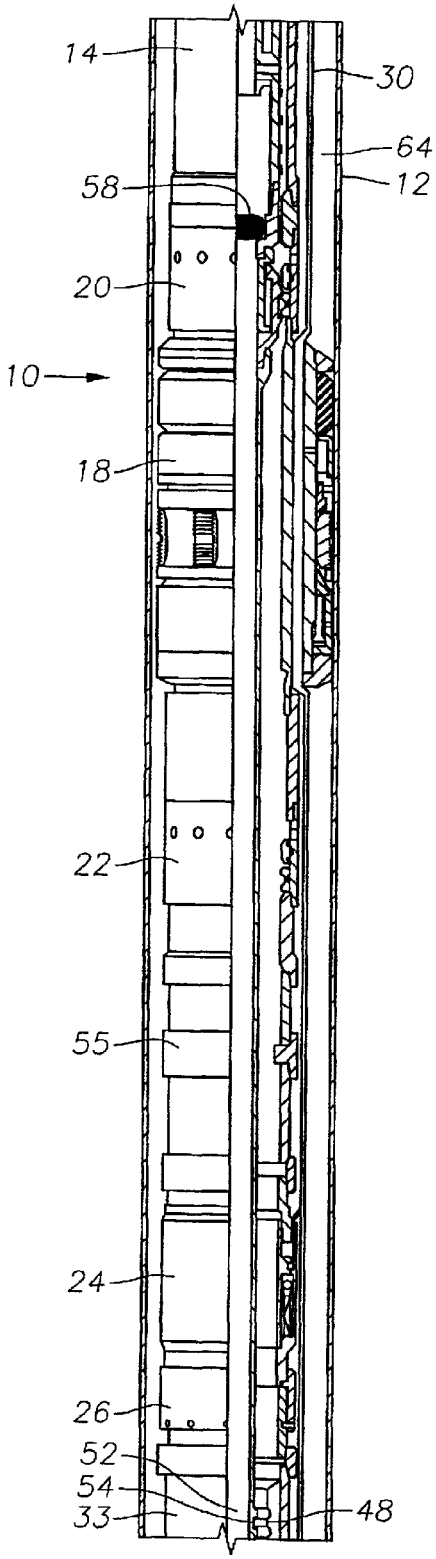
FIGS. 5A–5B illustrate a longitudinal view in partial cross-section of the embodiment shown in FIGS. 1A–1B, only now illustrating removal of a washpipe.
Figure 5B:
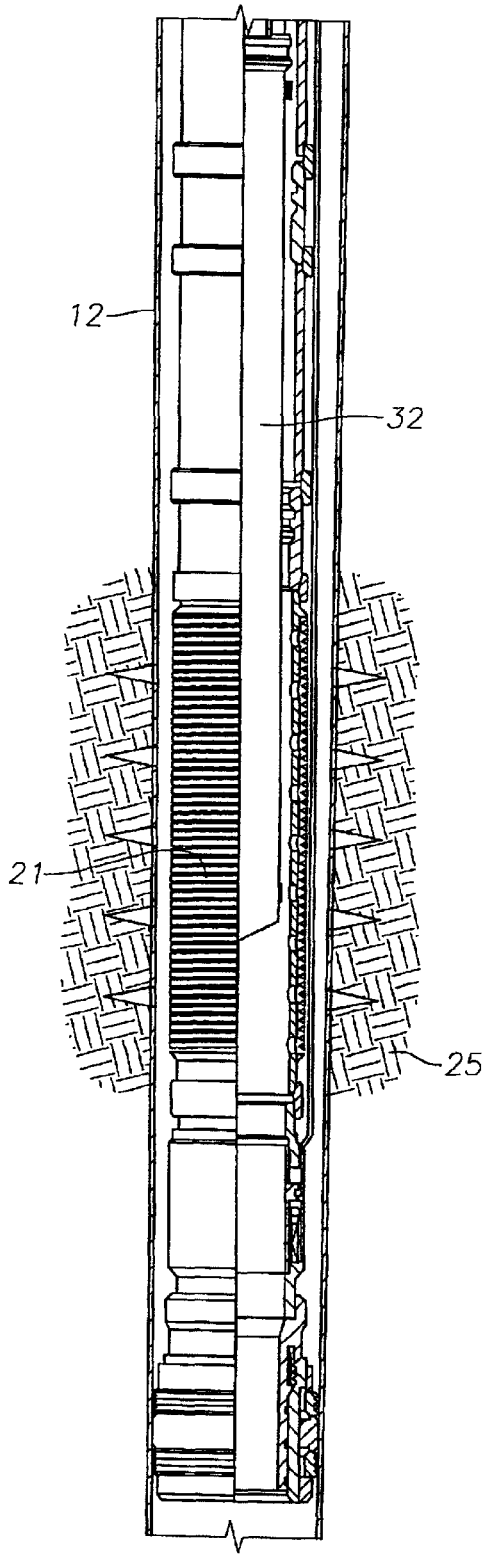
Figure 6A:
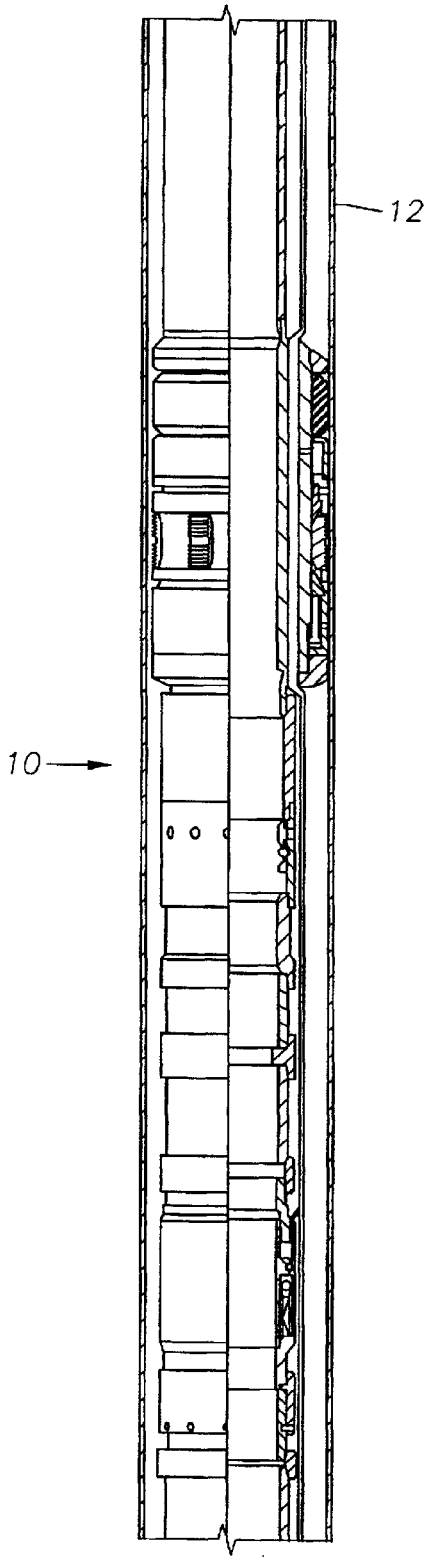
FIGS. 6A–6B illustrate a longitudinal view in partial cross-section of another embodiment of the present invention, with the completion in an installation position.
Figure 6B:
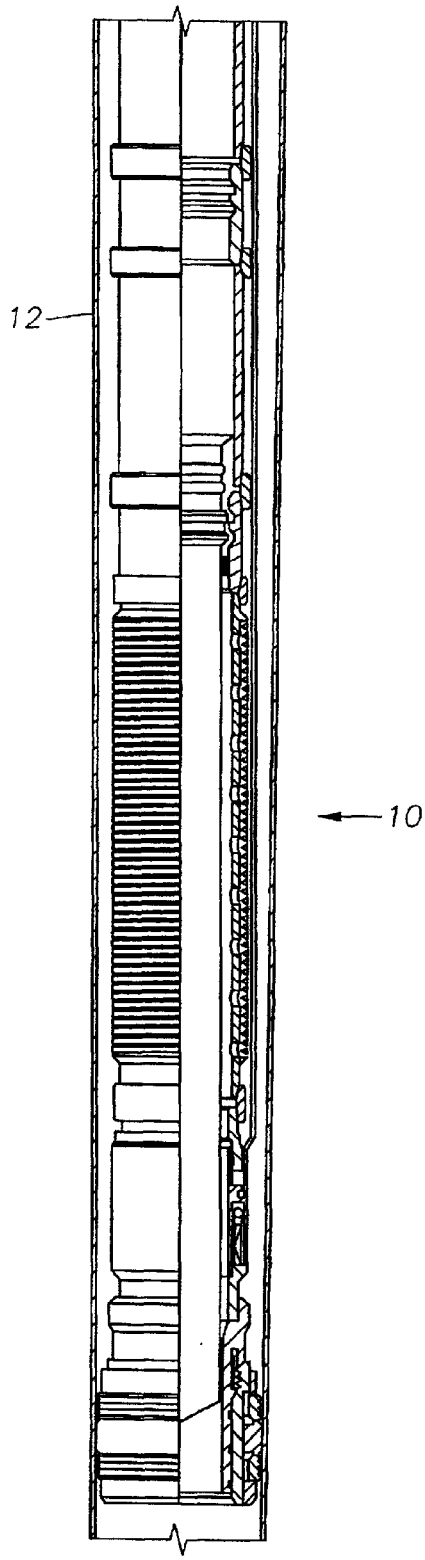
Figure 7A:
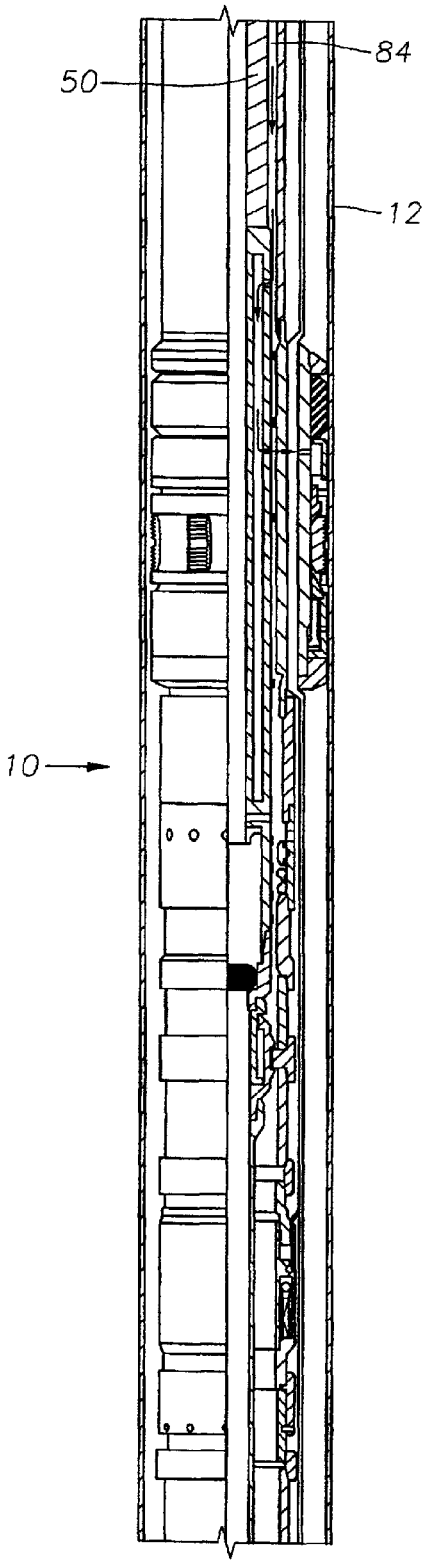
FIGS. 7A–7B illustrate a longitudinal view in partial cross-section of the embodiment shown in FIGS. 6A–6B, only now in a packer-setting and squeeze position.
Figure 7B:
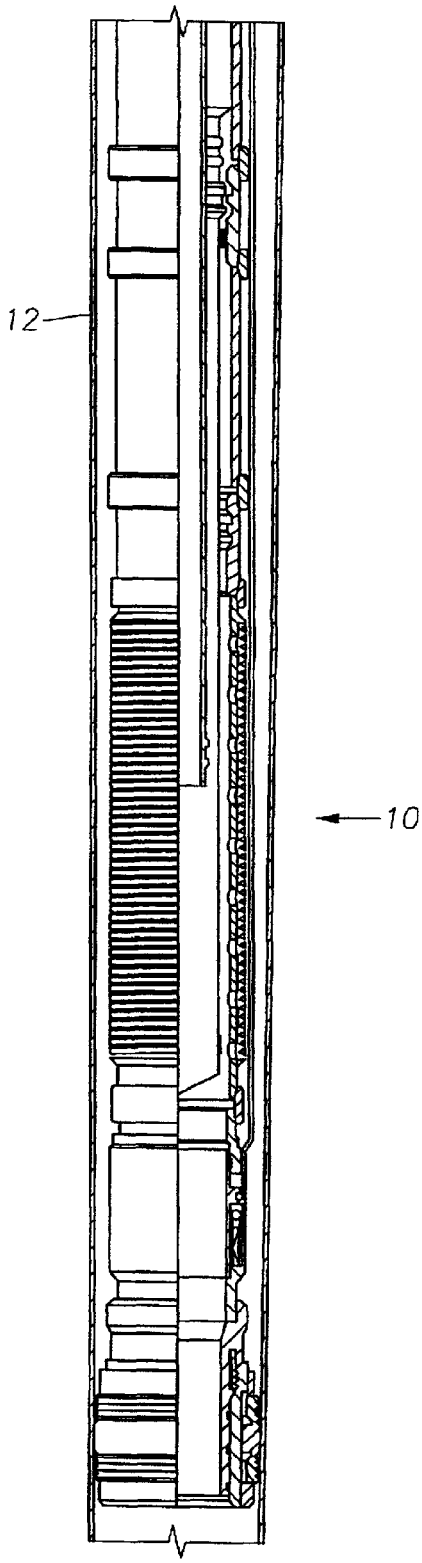
Figure 8A:
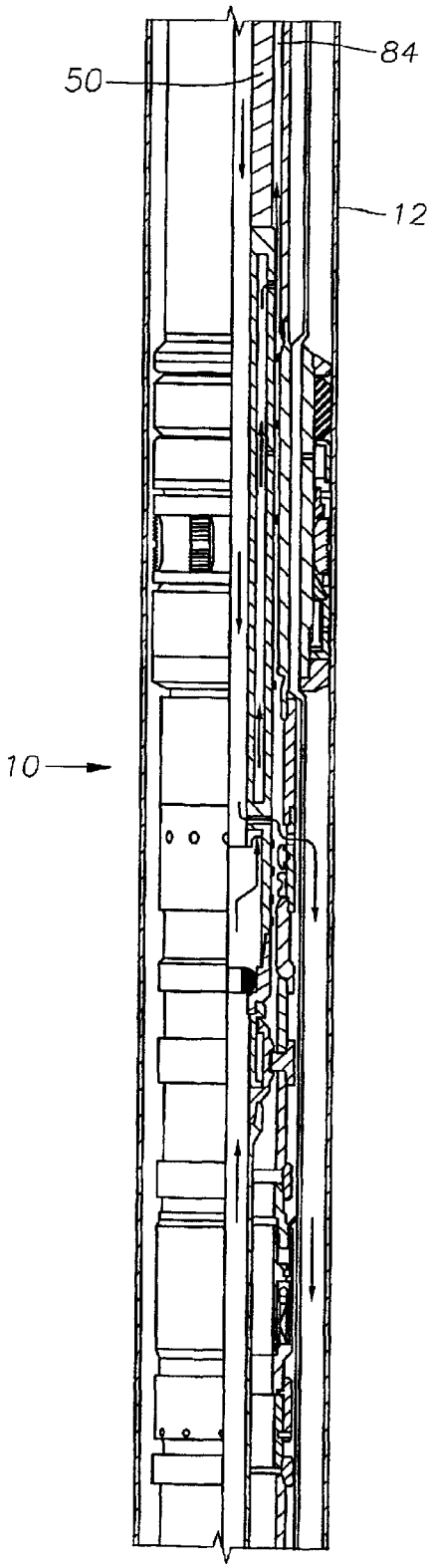
FIGS. 8A–8B illustrate a longitudinal view in partial cross-section of the embodiment shown in FIGS. 6A–6B, only now in a circulating position.
Figure 8B:
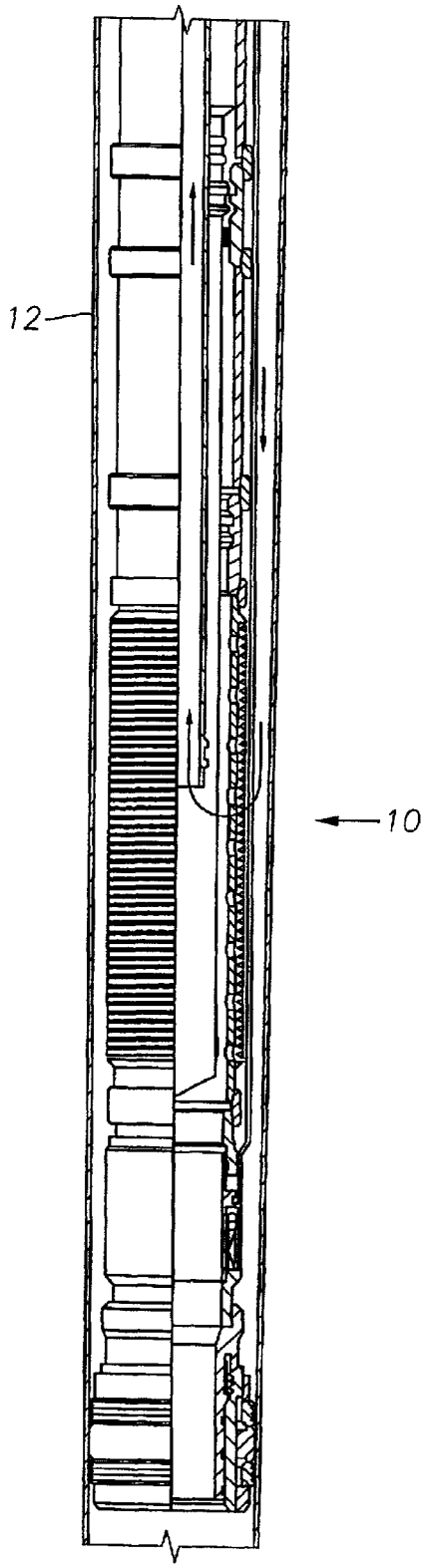
Figure 9A:
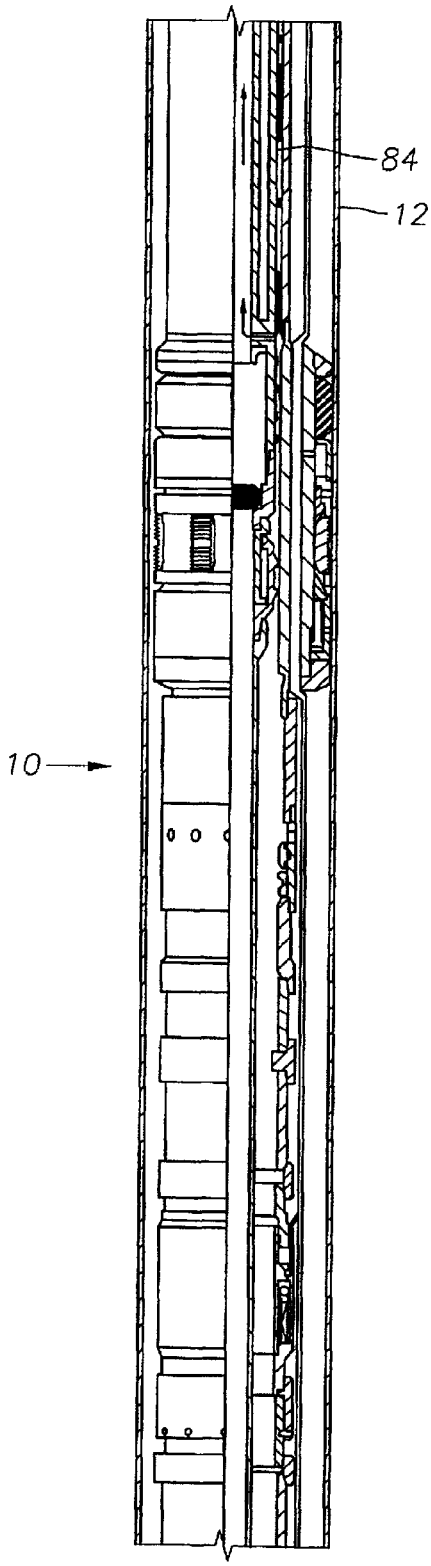
FIGS. 9A–9B illustrate a longitudinal view in partial cross-section of the embodiment shown in FIGS. 6A–6B, only now in a reverse circulating position.
Figure 9B:
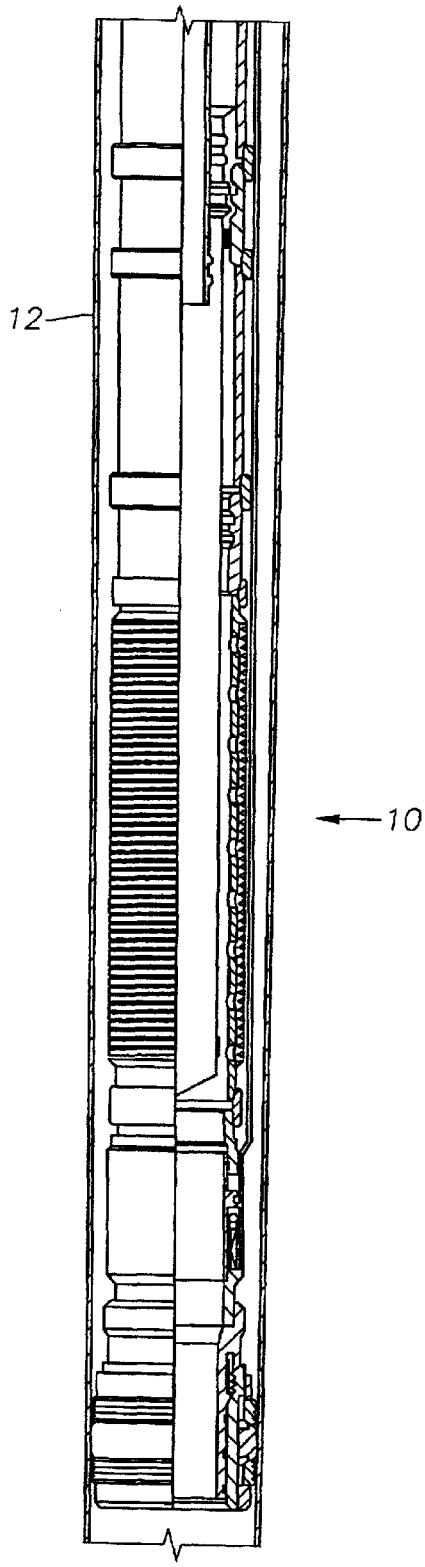
Figure 10A:
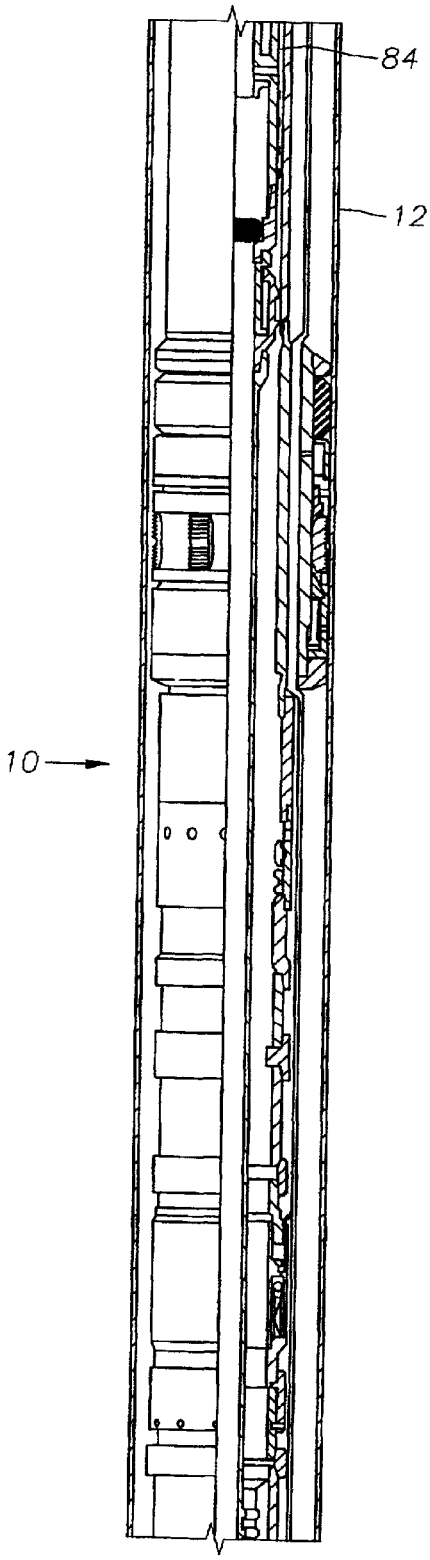
FIGS. 10A–10B illustrate a longitudinal view in partial cross-section of the embodiment shown in FIGS. 6A–6B, only now illustrating removal of the washpipe.
Figure 10B:
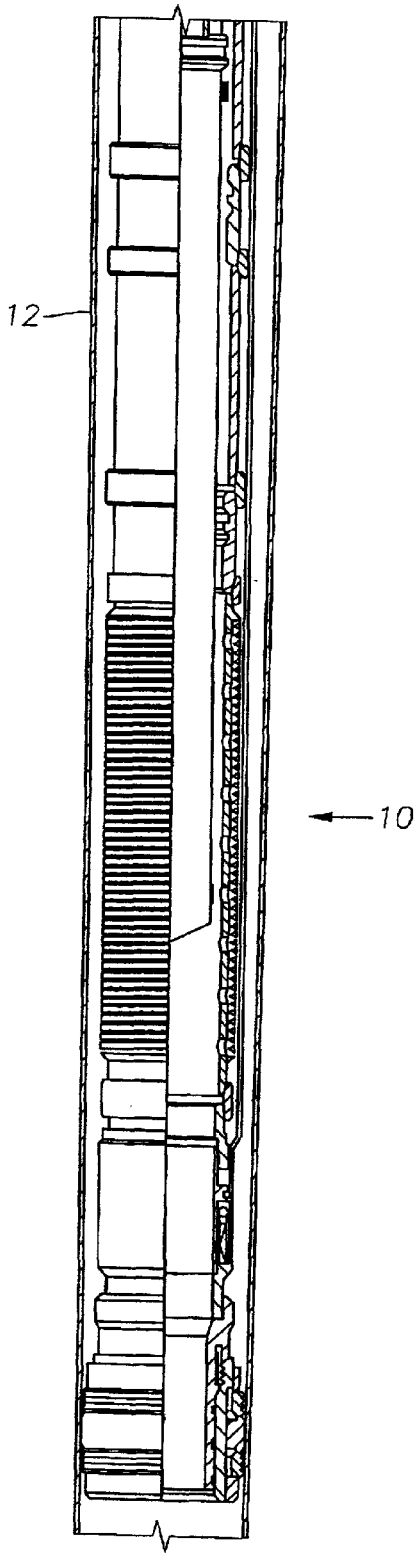

With reference to FIGS. 5A and 5B, the service tool 51 is shown with the gripping profile 54 on the lower end 52 of the service tool 51 engaged with the gripping profile 48 at the upper end 34 of the washpipe 32. The service tool 51 and the washpipe 32 are then retracted upwardly to the earth's surface, at which time production operations may commence.

Another embodiment of the completion 10 of the present invention is shown in FIGS. 6A through 10B. The structure and operation of this embodiment is very similar to the embodiment described above with regard to FIGS. 1A through 5B, with a difference being that the embodiment shown in FIGS. 6A through 10B lacks a closing sleeve and first polished bore receptacle above the upper packer 18. As such, in this embodiment, fluid circulation between the production tubing 14 and the annulus 64 above the upper packer 18 is not possible. Fluid flow is allowed, however, through an inner annulus 84 formed between the service string 50 and the production tubing 14, as shown at the top of FIGS. 7A, 8A and 9A. The structure and operation of the service string 50 and the service tool 51 are the same in this embodiment as is discussed above with regard to the other embodiment, with the only minor difference being that certain seals may be omitted here since there is no polished bore receptacle above the upper packer 18 to seal in.

It is to be understood that the invention is not limited to the exact details of construction, operation, exact materials or embodiments shown and described, as obvious modifications and equivalents will be apparent to one skilled in the art. For example, the various embodiments of the completion 10 of the present invention are shown disposed within a vertical, cased well bore. This should not be taken as a limitation. Instead, the invention is equally application to open hole and/or horizontal well bores. Accordingly, the invention is therefore to be limited only by the scope of the appended claims.

What is claimed is:

1. A sand screen for use in production of hydrocarbons from wells, comprising an intelligent completions device disposed in the sand screen, wherein the intelligent completions device comprises a sensor selected from the group consisting of a temperature sensor, a flow rate measurement device, a scale detector, and a sand detection device.

2. The sand screen of claim 1, wherein the intelligent completions device comprises the temperature sensor.

3. The sand screen of claim 1, wherein the intelligent completions device comprises the flow rate measurement device.

4. The sand screen of claim 1, wherein the intelligent completions device comprises the scale detector.

5. The sand screen of claim 1, wherein the intelligent completions device comprises the sand detection device.

6. A gravel pack system, comprising:

a sand screen; and an intelligent completions device disposed within the sand screen, wherein the intelligent completions device comprises a sensor selected from the group consisting of a temperature sensor, a flow rate measurement device, a scale detector, and a sand detection device.

7. The gravel pack system of claim 6, wherein the intelligent completions device comprises the flow rate measurement device.

8. The gravel pack system of claim 6, wherein the intelligent completions device comprises the temperature sensor.

9. The gravel pack system of claim 6, wherein the intelligent completions device comprises the scale detector.

10. The gravel pack system of claim 6, wherein the intelligent completions device comprises the sand detection device.

11. The gravel pack system of claim 6, further comprising a control line connected to the intelligent completions device.

12. The gravel pack system of claim 11, wherein the control line is selected from an electric line and a fiber optic line.

13. The gravel pack system of claim 6, further comprising a control line extending from the surface to the intelligent completions device.

14. The gravel park system of claim 6, further comprising an assembly to perform a gravel pack operation.

15. A gravel pack system comprising:

a sand screen;

an intelligent completions device disposed within the sand screen; and a fiber optic cable.

16. A method for placing a gravel pack around a completion, comprising:

gathering data from an intelligent completions device disposed in a sand screen of the completion, the intelligent completions device selected from the group consisting of a temperature sensor, a flow rate measurement device, a scale detector, and a sand detection device; and flowing a gravel slurry into the assembly wherein a gravel is deposited between the sand screen and a formation.

17. A method of monitoring a well characteristic of a well, comprising:

running a control line to an intelligent completions device disposed in a sand screen, the intelligent completions device selected from the group consisting of a temperature sensor, a flow rate measurement device, a scale detector, and a sand detection device;

running the sand screen into the well; and sending a signal through the control line.

18. The method of claim 17, further comprising performing sand-control pumping and circulation operations.

19. A method for gravel packing a well, comprising:

running a sand screen into a particular length of the well;

extending a fiber optic line into the particular length of the well; and gravel packing the well.

20. The method of claim 19, further comprising performing the running step at substantially the same time as the extending step.

21. The method of claim 19, further comprising performing the running step before the extending step.

22. A well completion, comprising:

a sand screen;

an intelligent device disposed within the sand screen, the intelligent device selected from the group consisting of a temperature sensor, a flow rate measurement device, a scale detector, a sand detection device, and a flow control device; and a service string adapted to perform sand-control pumping and circulation operations.

23. A sand screen for use in production of hydrocarbons from wells, comprising an intelligent completions device disposed in the sand screen, wherein the intelligent completions device comprises a device selected from the group consisting of a temperature sensor, a flow rate measurement device, a scale detector, a sand detection device, and a flow control device.

24. A gravel pack system, comprising:

a sand screen; and an intelligent completions device disposed within the sand screen, wherein the intelligent completions device comprises a sensor selected from the group consisting of a temperature sensor, a flow rate measurement device, a scale detector, a sand detection device, and a flow control device.

25. A method of monitoring a well characteristic of a well, comprising:

running a control line to an intelligent completions device disposed in a sand screen, the intelligent completions device selected from the group consisting of a temperature sensor, a flow rate measurement device, a scale detector, a sand detection device, and a flow control device;

running the sand screen into the well; and sending a signal through the control line.

* * * * *